US005435731A

United States Patent [19]

Kang

[11] Patent Number: 5,435,731

[45] Date of Patent: Jul. 25, 1995

[54] ROTATABLE HIDDEN CONNECTOR FOR TELEPHONE TRANSMITTER

[76] Inventor: Steve Kang, No. 49, Lane 81, Lee Sinn Road, Sec. 2, Sanchung City, Taipei Hsien, Taiwan

[21] Appl. No.: 241,923

[22] Filed: May 12, 1994

[51] Int. Cl.[6] ..... H01R 39/08

[52] U.S. Cl. ..... 439/26

[58] Field of Search ..... 439/21, 23–26, 439/20

[56] References Cited

U.S. PATENT DOCUMENTS

| | | | |
|---|---|---|---|
| 4,764,121 | 8/1988 | Ditzig | 439/26 |
| 5,106,306 | 4/1992 | Ditzig | 439/26 |
| 5,234,347 | 8/1993 | Kang | 439/26 |

*Primary Examiner*—Gary F. Paumen
*Attorney, Agent, or Firm*—Pro-Techtor International

[57] ABSTRACT

A rotatable connector installed in a telephone transmitter and used for connecting a coiled conductor and the transmitter to effectively prevent the coiled conductor from twisting. The connector includes a housing, four conductors for connecting to a microphone and a receiver in the transmitter, four annular guide pieces which can be mounted on a rotation seat and held in the housing and composed of four semicircular piercing guide pieces and four semi-circular guide pieces, a jack for the coiled conductor held in the housing and having several electrically conducting spring strips thereon. The jack can be freely rotated relative to the housing while keeping the spring strips in electric contact with the corresponding annular guide pieces.

1 Claim, 5 Drawing Sheets

ROTATABLE HIDDEN CONNECTOR FOR TELEPHONE TRANSMITTER

BACKGROUND OF THE INVENTION

1. Field of the invention

The present invention relates to a rotatable connector for telphone transmitter, and especially to a rotatable connector hidden in the transmitter for connecting between a coiled conductor and the transmitter to effectively prevent the coiled conductor from twisting.

2. Description of the Prior Art

The body of a telephone and the transmitter are normally connected to each other by a coiled conductor with the both ends of which each having a clip connecting plug. While the coiled conductor will be over twisted due to the frequent changing of the relative positions between the telephone body and the transmitter in frequent use of the transmitter; such over twisted coiled conductor leads to inconveniency of use, and the over twisting phenomenon after a long period of use will render the coiled conductor to yield an elastic fatigue state and further lose the proper recovering function and thus adversely affect the electrical connecting capability, which can greatly disgrade the communication quality. The inventor has provided a device in the U.S. Pat. No. 5,234,347 to prevent the coiled transmitter conducter from twisting.

SUMMARY OF THE INVENTION

The object of the present invention is to provide a rotatable connector similar to that disclosed in U.S. Pat. No. 5,234,347, but the connector is received in a telephone transmitter of the present invention as a hidden connector and can effectively prevent the coiled conductor from twisting.

To achieve the above stated objects, the present invention includes: a housing; a rotation seat, whereon in the middle portion of the seat there are four conductors connected respectively to a microphone and a receiver within the transmitter; and four sets of annular guide pieces fixed on the abovementioned rotation seat and composed of four semi-circular piercing guide pieces and four semi-circular guide pieces, wherein each semi-circular piercing guide piece includes a piercing member adapted to pierce the surface layer of one of the four conductors to electrically connect to the corresponding conductor; and four electrically conducting spring strips each being in sliding contact with a corresponding annular guide piece are provided, the electrically conducting spring strips are fixedly mounted on a jack (for the coiled transmitter conductor) which is fixed on the housing. The rotatable hidden connector of such a device is installed in the transmitter end of the telephone set. A hole is provided on the jack for the transmitter conductor for insertion of bending ends of the above-mentioned electrically conducting spring strips. In this way, when the jack is inserted by the plug on one end of the coiled conductor, electrical connection is provided between the transmitter and the telephone set. Thus the transmitter conductor can be unwound from twisting when the coiled conductor is used together with the transmitter, i.e., no twist is left.

BRIEF DESCRIPTION OF THE DRAWINGS

The structural features and the practical functions of the present invention is now described in detail as followings referring to the accompanied drawings, as can help to understand it.

In the drawings.

DETAILED DESCRIPTION OF THE PREFERRED EMBODIMENT

Figure 1:
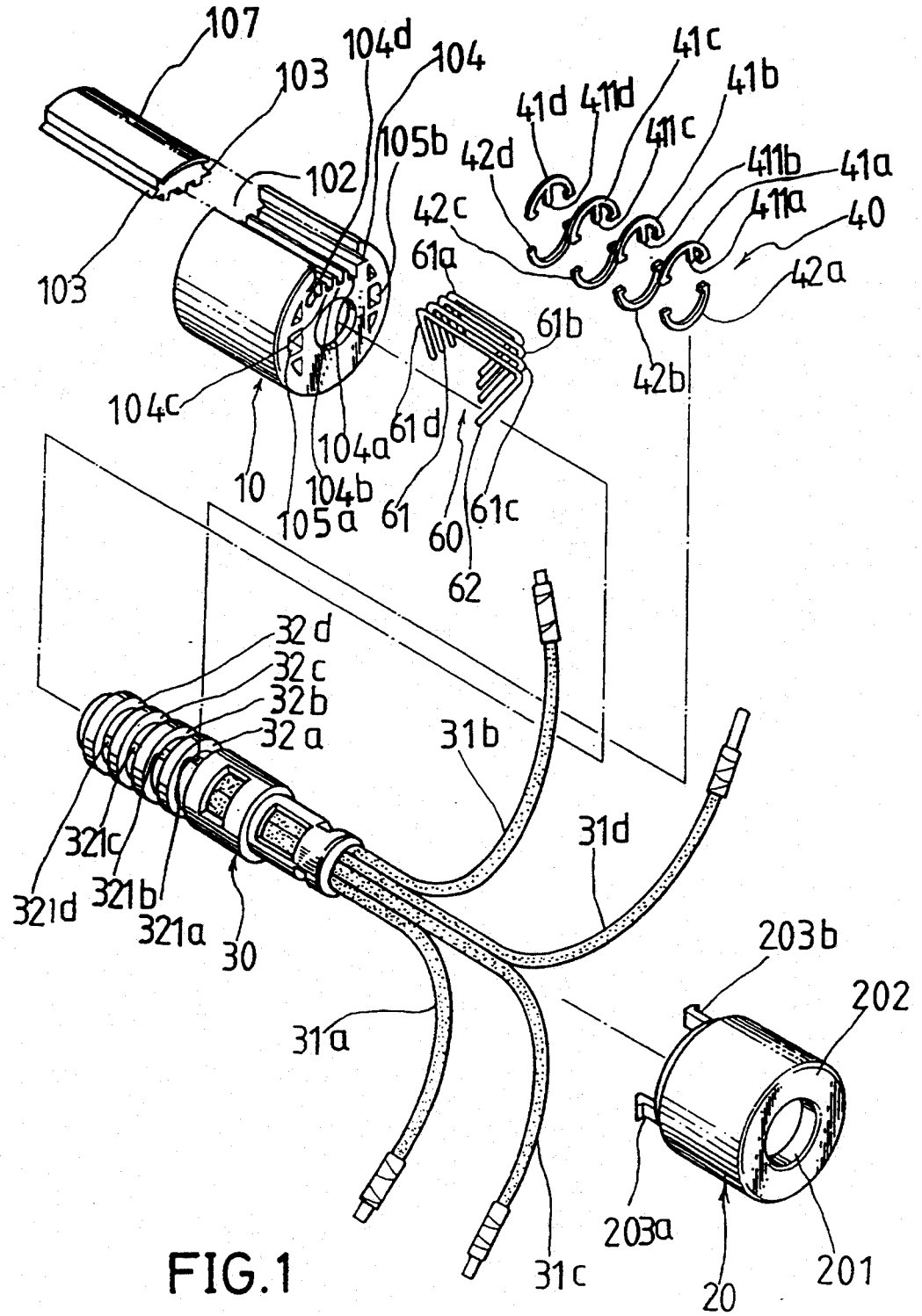
FIG. 1 is an exploded view of the members constructing the present invention.

Referring to FIG. 1, 2, the structure of the present invention is comprised of:

A jack 10 with a central cavity 101 therein, the jack 10 being adapted to receive a conventional coiled conductor (not shown), the transmitter thus being electrically connected with a telephone set, an axially extending groove 102 is provided on the outer and upper surface of the jack 10, on each side of the groove 102 is a dovetail groove 104, on the top of the groove 102 a lid 107 with a dovetail rib 103 on each side thereof may cover the groove 102, on the bottom of the groove 102 are four axially extending slots 104*a, b, c, d*.

A housing 20: the interior thereof being hollowed and having a central round hole 201 and an annular shoulder 202 on one end thereof, thus allowing a rotation seat 30 (to be stated later) to be inserted and rotatably placed therein, and allowing connecting of a plurality of insertion hooks 203*a, b* on the other end thereof with a plurality of insertion holes 105*a, b* on the jack 10, such that the rotation seat 30 can be located and restricted between the conductor jack 10 and the housing 20 for rotation of the rotation seat 30.

A rotation seat 30: an axially extending through hole being provided therein for inserting of four soft extension conductors 31*a, b, c, d* for the transmitter, and four annular grooves 32*a, b, c, d* being provided thereon and each having a diametrical through notch 321*a, b, c, d* respectively extending through the body of the rotation seat 30, while the circumferential positions of each successive notch are rotated.

Figure 3:
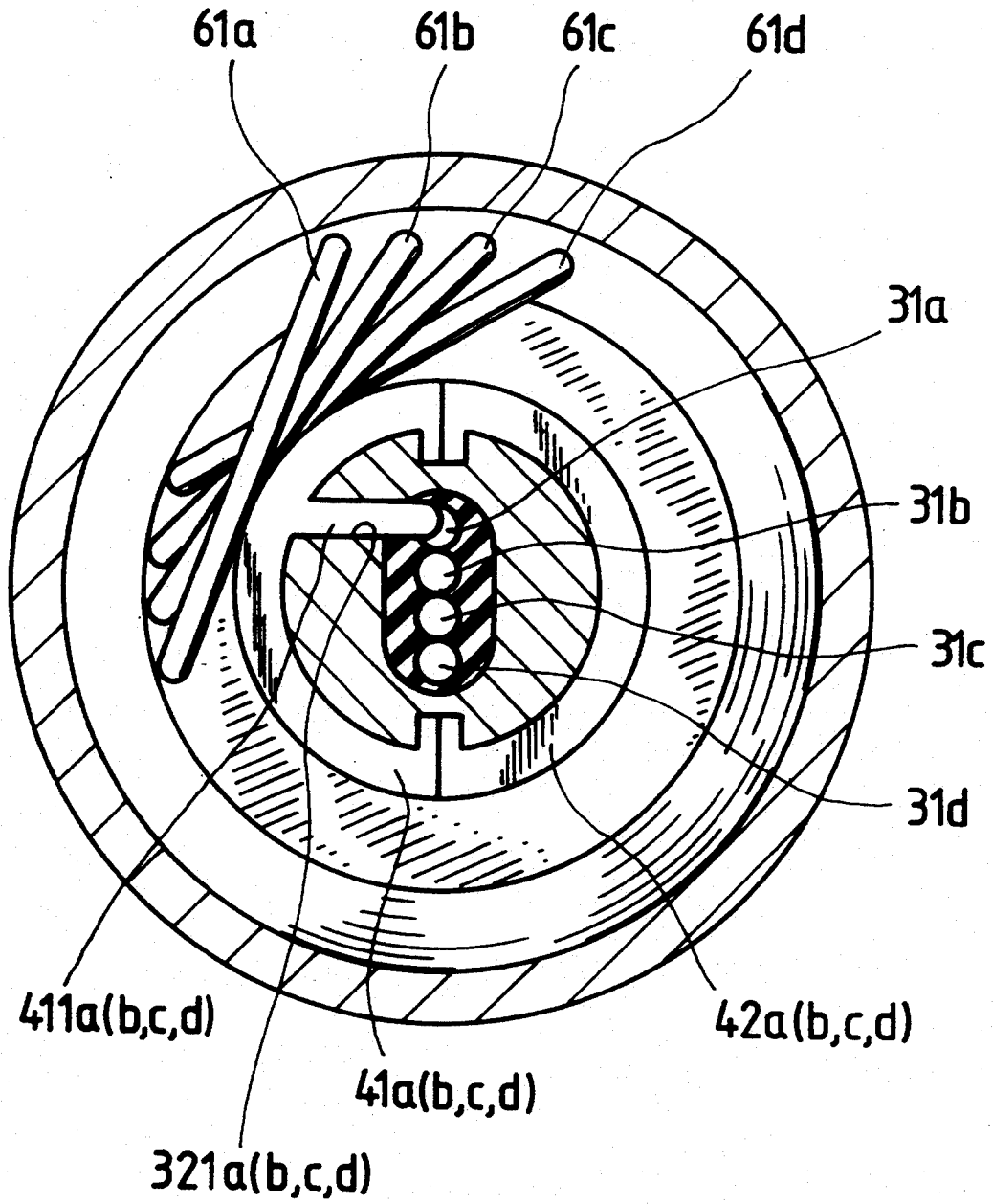
FIG. 3 is a horizontal sectional view of the present invention from the sectional line 3—3 in FIG. 2.

Annular guide pieces 40: being four sets totally, and being composed of four semi-circular piercing guide pieces 41*a, b, c, d* each having a piercing member 411*a, b, c, d* in different positions, and also composed of four semi-circular guide pieces 42*a, b, c, d*; these semi-circular piercing guide pieces 41*a, b, c, d* and the opposite semi-circular guide pieces 42*a, b, c, d* being received respectively in the corresponding one of the annular grooves 32*a, b, c, d* of the abovementioned rotation seat 30, and the semi-circular piercing guide pieces 41*a, b, c, d* extending through the through notches 321*a, b, c, d* and piercing through the plastic surface layer of the four conductors 31*a, b, c, d* to contact the four core wires therein arranged in vertical alignment (as shown in FIG. 3). Each annular guide piece 40 being in sliding contact respectively with one of the four electrically conducting spring strips 60 (being stated later) fixedly mounted in the groove 102 on the top of the jack 10 for the transmitter conductor.

Electrically conducting spring strips 60: the lengths of all the four conducting spring strips 60 being different from one another, and each having a front end 61 and a rear end 62 all bending downwards respectively; the front ends 61 (*a, b, c, d*) being in sliding contact with the annular guide pieces 40, while the rear ends 62 inserting into the central bore 101; the spring strips 60 being kept in position by a lid 107 covering the groove 102 on the jack 10. When the conductor plug 106 of the transmitter extending into the central bore 101, electric connection with the conductors 31*a,b,c,d* being achieved (please referring to FIG. 4).

Figure 2:
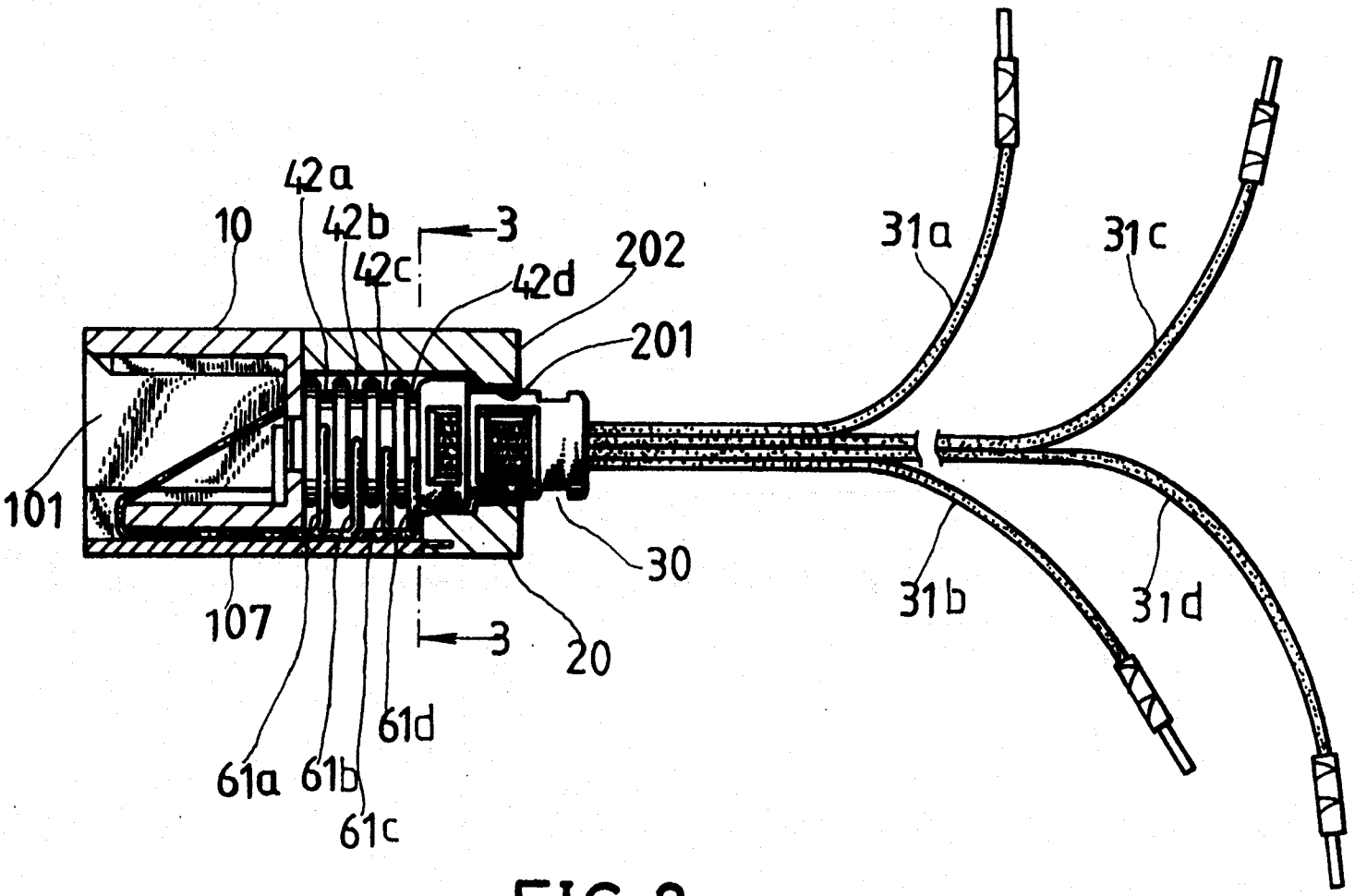
FIG. 2 is an assembled sectional view of the present invention as shown in FIG. 1.
Figure 4:
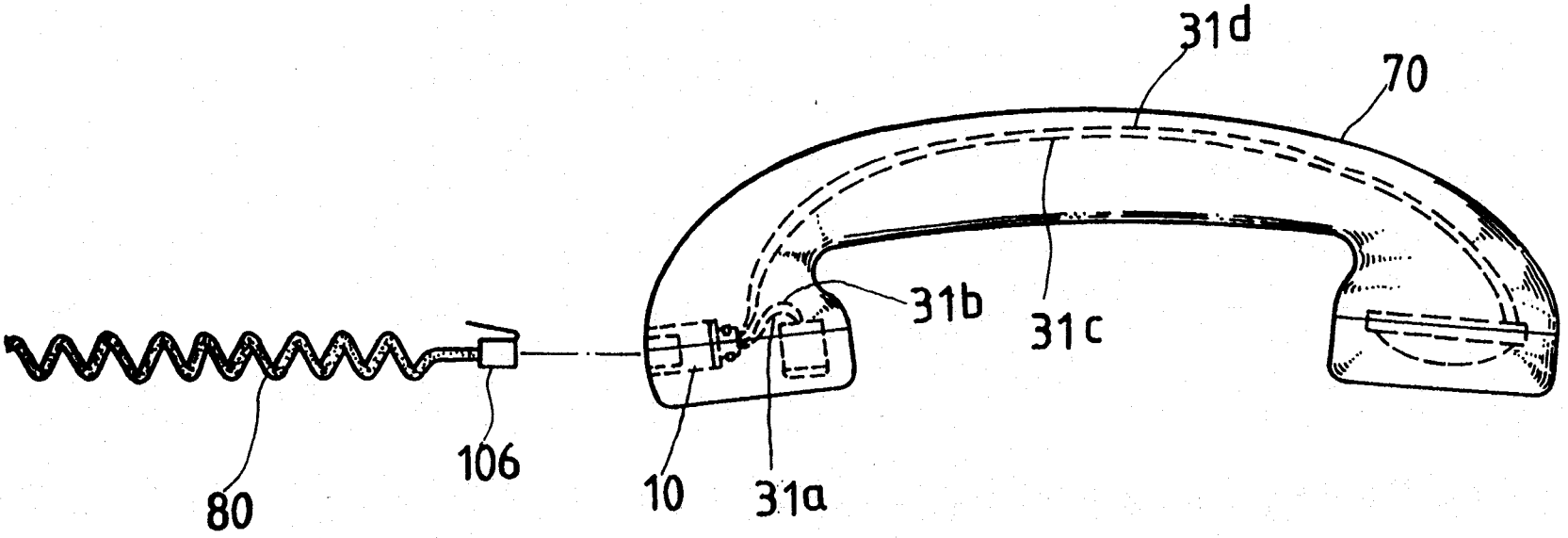
FIG. 4 is a schematic front view of the present invention showing the present invention is installed in a transmitter.
Figure 5:
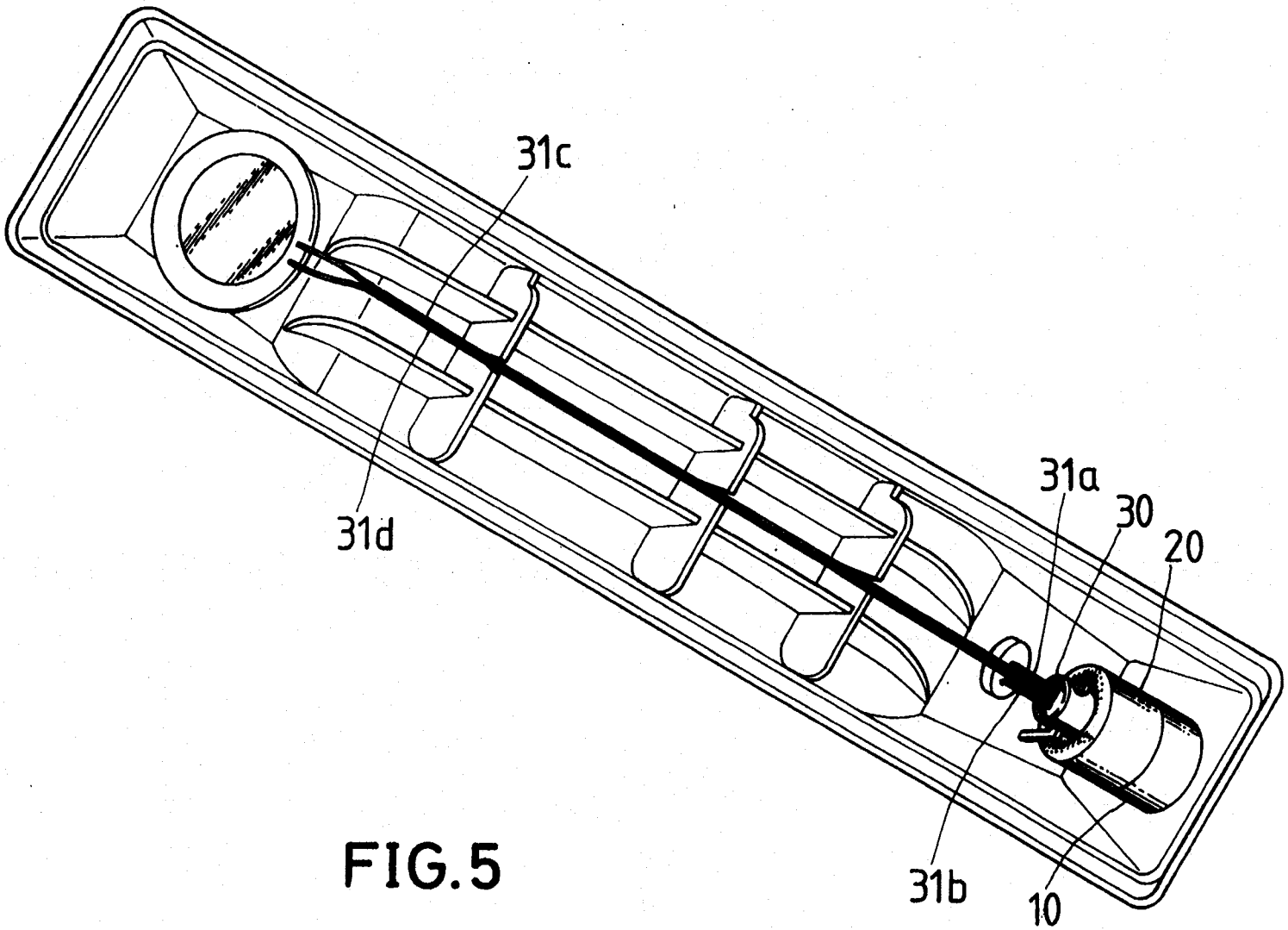
FIG. 5 is an enlarged top view of the present invention when it is installed in a transmitter.

According to the aforesaid structure, and referring to FIG. 2, the combination of the present invention is completed by installing the structure in the transmitter, and inserting the plug of a coiled conductor 80 into the central bore 101 of the conductor jack 10, and then connecting the transmitter conductors 31*a, b* on the rotation seat 30 to a microphone and connecting the transmitter conductors 31*c, d* to the receiver of the telephone set, such as the case shown in FIG. 4, 5 in which the jack 10 is in the transmitter 70.

In using of the present invention, as shown in FIG. 4, when the coiled conductor 80 is rotated due to the motion of the transmitter 70, the jack 10 connecting to the conductor 80 and the housing 20 connecting to the jack 10 can rotate freely against the rotation seat 30. Therefore, the conductor 80 will not be twisted, and the electrically conducting spring strips 60 are in sliding contact with the annular guide pieces 40, so that electric connection is maintained. The present invention may assume numerous forms and is to be construed as including all modifications and variations falling within the scope of the appended claims.

I claim:

1. A rotatable connector for a telephone transmitter comprising:

a housing, a rotation seat, a plurality of annular guide pieces, a jack adapted to receive a transmitter conductor, and a plurality of electrically conducting spring strips; wherein said housing includes a hollow interior and has two insertion holes on a first end thereof;

said jack includes a central cavity at a first end thereof to receive said transmitter conductor, and said jack further includes two insertion holes on a second end thereof to receive said insert insertion hooks on said housing, a top surface of said jack includes a recessed area with axial slots on a top surface thereof, said axial slots being adapted to receive axial projections on a lower surface of a lid, the recessed area further including on each side a groove adapted to receive a tongue included on each side of said lid;

said rotation seat including four conductors extending from a forward end, and further including four annular grooves on a rear portion thereof, each annular groove including a through notch, each said notch occupying a different circumferential position;

each said annular guide piece including a semi-circular piercing guide with a piercing member and a semi-circular guide piece, each said annular guide piece being received in a corresponding annular groove, with the piercing member of the piercing guide piece being received in said through notch of said groove, said piercing members piercing insulative layers of said conductors to form electrical connection therewith;

said electrically conducting spring strips being four in number, and being kept in position in said axial slots on said top surface of said jack, said spring strips being different in length and having front and rear ends that bend downward, said front ends each being in tangential sliding contact with a corresponding annular guide piece.

* * * * *